United States Patent [19]

Young

[11] Patent Number: 5,016,682

[45] Date of Patent: May 21, 1991

[54] ELECTRIC WIRE TWISTING MACHINE

[76] Inventor: Chuang P. Young, 1 Fl., No. 3, 4 Alley, 225 Lane, Chung Hsiao E. Road, Sec. 6, Taipei, Taiwan

[21] Appl. No.: 467,955

[22] Filed: Jan. 22, 1990

[51] Int. Cl.[5] ..... B21F 7/00

[52] U.S. Cl. ..... 140/149

[58] Field of Search ..... 140/147, 149; 29/748

[56] References Cited

U.S. PATENT DOCUMENTS

| | | | |
|---|---|---|---|
| 2,727,541 | 12/1955 | Preston | 140/149 |
| 2,783,525 | 3/1957 | Scharf | 140/149 |
| 3,348,586 | 10/1967 | Campbell et al. | 140/147 |

*Primary Examiner*—Lowell A. Larson

*Attorney, Agent, or Firm*—Ostrolenk, Faber, Gerb & Soffen

[57] ABSTRACT

An electric wire twisting machine includes a transmission mechanism comprising a motor to carry a driving rod set and a driving fear set to operate, an electric wire top clamping mechanism driven by the driving gear set to clamp and carry the copper threads of the wire top of an electric wire inserted therein, and an electric wire twisting mechanism driven by the driving rod set to twist and carry the root portion of such an electric which has its wire top clamped by the electric wire top clamping mechanism so as to let the copper threads of the wire top of such an electric wire be twisted into a cord.

11 Claims, 4 Drawing Sheets

ELECTRIC WIRE TWISTING MACHINE

BACKGROUND OF THE INVENTION

This invention relates to an electric wire twisting machine and more particularly to the one which can efficiently twist the copper threads of the wire top of an electric wire into a cord.

The copper threads of the wire top of an electric wire must be twisted into a cord to prevent from breaking up so that welding connection can be efficiently performed. Conventionally, the copper threads of the wire top of electric wire are twisted into a cord by the hands. It is indeed very time-consuming to twist the copper threads of the wire top of an electric wire into a cord. In addition to time-consuming problem, quality is yet another problem to settle.

It is therefore, the main object of the present invention to provide an electric wire twisting machine which can replace manual operation to efficiently twist the copper threads of the wire top of an electric wire into a cord.

Embodiments of the present invention will now be described by way of example, with reference made to the annexed drawings in which:

DETAILED DESCRIPTION OF THE PREFERRED EMBODIMENTS

Figure 1:
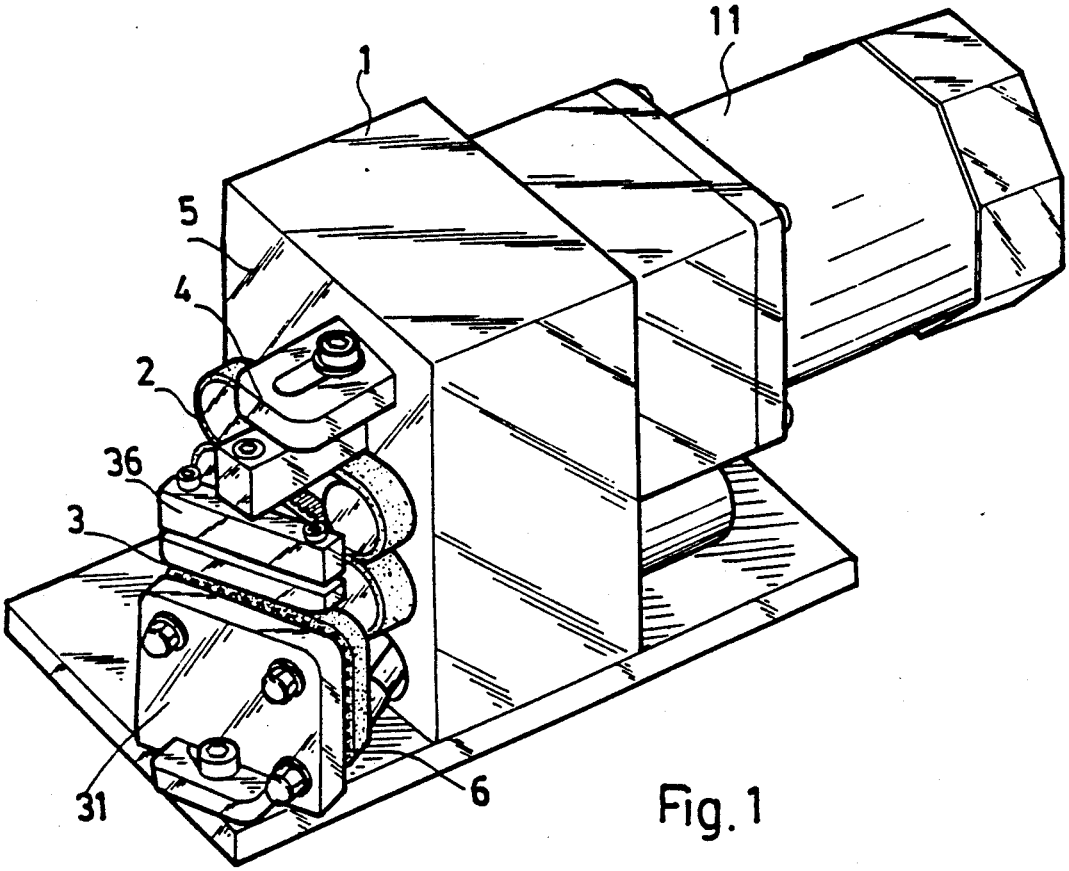
FIG. 1 is a perspective view of an electric wire twisting machine embodying the present invention.
Figure 2:
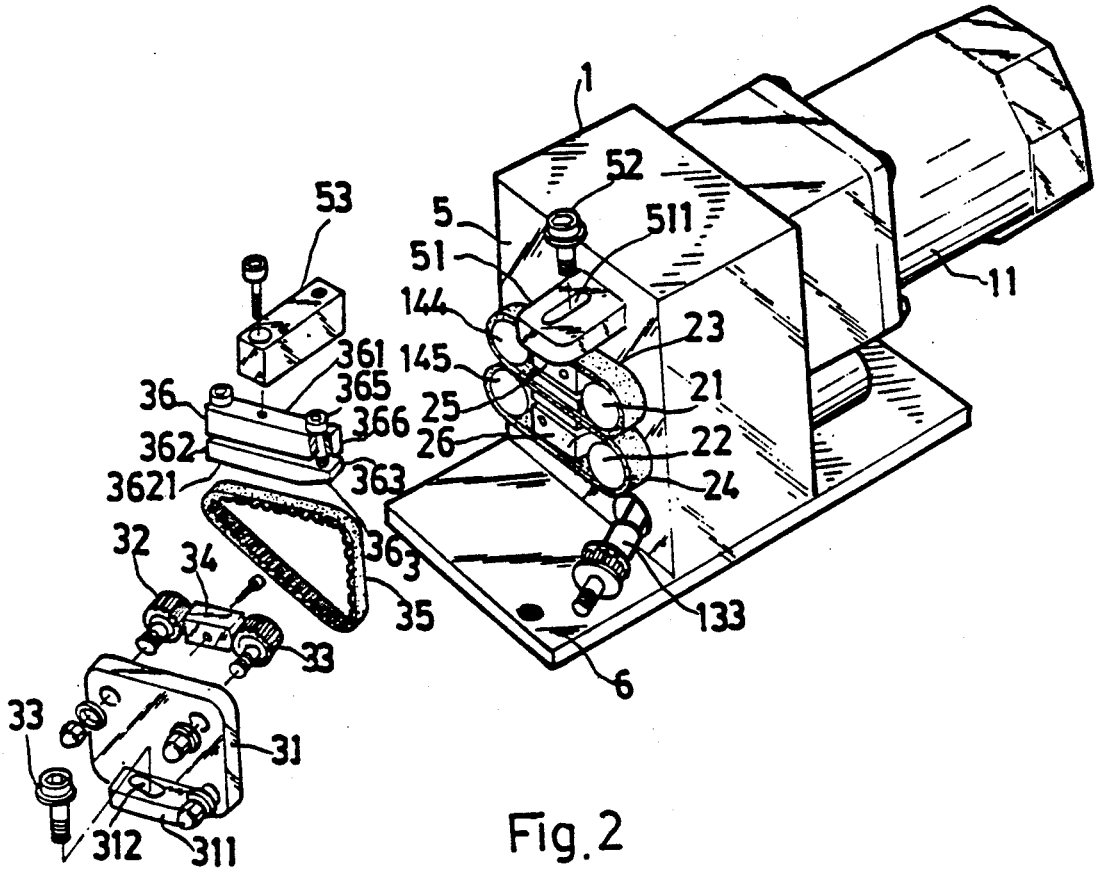
FIG. 2 is a perspective fragmentary view of the electric wire twisting mechanism of the electric wire twisting machine of FIG. 1.
Figure 3:
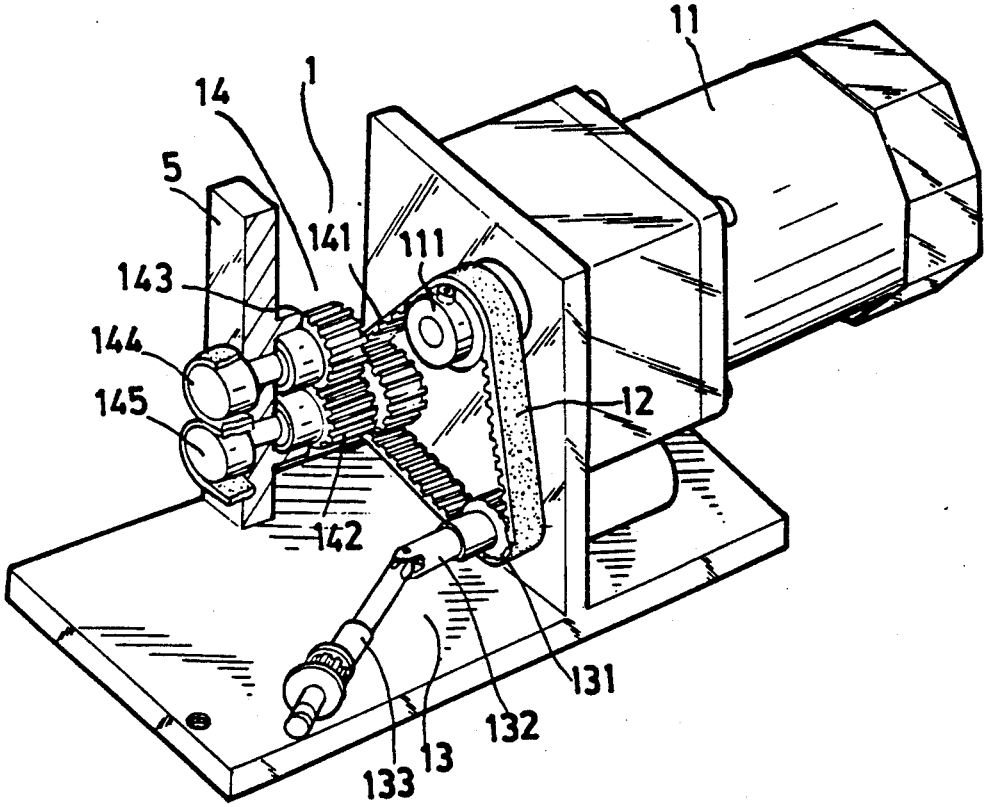
FIG. 3 is a perspective fragmentary view of the transmission mechanism of the electric wire twisting machine of FIG. 1.

Turning now to the annexed drawings in greater detail, therein illustrated is an electric wire twisting machine embodying the present invention and generally comprised of a transmission mechanism 1, an electric wire top clamping mechanism 2, an electric wire twisting mechanism 3, and a position adjusting mechanism 4.

The transmission mechanism 1 includes a motor 11 having connected thereto a revolving shaft 111 to drive a driving rod set 13 and a driving gear set 14 through a corrugated driving belt 12. The driving rod set 13 comprises a gear wheel 131, which is driven to rotate by the corrugated driving belt 12, an extension rod 132, which is connected with the gear wheel 131 through universal coupling, and a linking rod 133, which is coupled with the extension rod 132 and penetrates through the housing of the transmission mechanism 1 to drive the electric wire twisting mechanism 3 to operate. The driving gear set 14 comprises a first gear wheel 141, which has teeth in number much more than the gear wheel 131 of the driving rod set 13 and is driven to rotate by the corrugated driving belt 12, a second gear wheel 142, which is coaxially connected to the first gear wheel 141 and has its gear shaft penetrating through a division plate 5 to carry a second belt pulley 145 to rotate, a third gear wheel 143, which is engaged with the second gear wheel 142 at the top and has its gear shaft penetrating through the division plate 5 to carry a first pulley wheel 144 to rotate.

Figure 4:
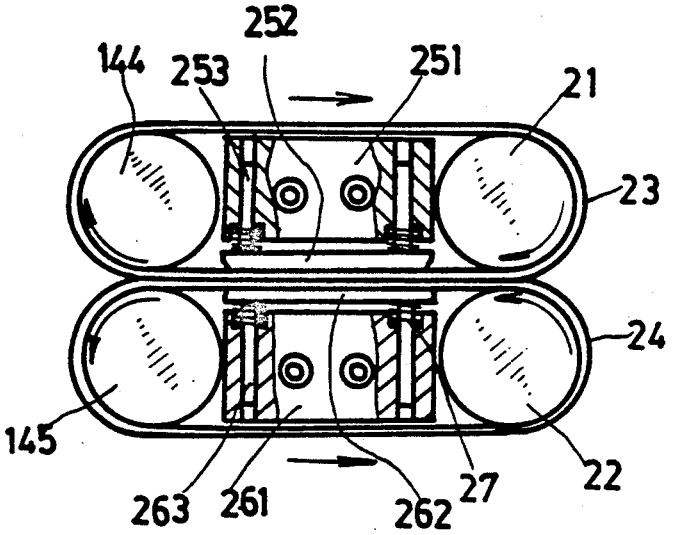
FIG. 4 is a sectional structural view of the wire top clamping mechanism of the electric wire twisting machine of FIG. 1.

The electric wire top clamping mechanism 2 includes two belt pulleys 21 and 22 mounted on the division plate at one lateral side and disposed opposite to and in parallel with the first and second belt pulleys 144 and 145 of the driving gear set 14, two endless belts 23 and 24 respectively mounted on the belt pulleys 21 and 144 and the belt pulleys 22 and 145, and two holding-down devices 25 and 26 mounted on the division plate 5 and surrounded by the two endless belts 23 and 24 respectively. The holding-down devices 25 and 26 are oppositely disposed to clamp the endless belts 23 and 24 therebetween. As illustrated in FIG. 4, the holding-down devices 25 and 26 each is comprised of a positioning seat 251 or 261, a pair of slide rods 253 or 263 in the positioning seat 251 or 261, a pair of spring elements 27 on the slide rods 253 or 263, and a pressure plate 252 or 262 mounted on the slide rods 253 or 263 and constantly forced by the spring elements 27 thereon to press on the endless belt 23 or 24. Because the two holding-down devices 25 and 26 are respectively disposed to face each other, the two pressure plates 252 and 262 are constantly forced to press on the middle part of the two endless belts 23 and 24 from both sides elements 27 on the slide rods 253 or 263.

Figure 5:
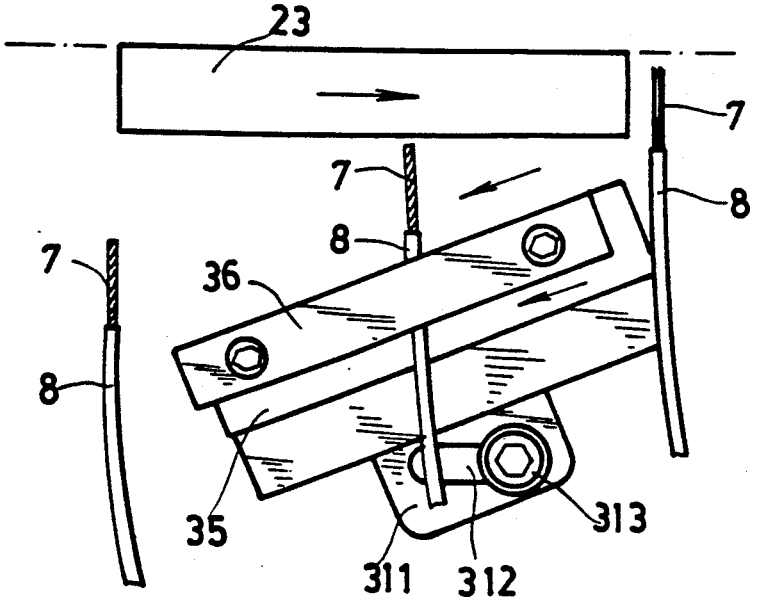
FIG. 5 is a schematic drawing illustrating the operation of the present invention to twist an electric wire.

The electric wire twisting mechanism 3 includes a vertical steering board 31 coupled with the linking rod 133 of the transmission mechanism 1 and having a transverse lug 311 at its lower front end, which transverse lug 311 has a control slot 312 for insertion therethrough of a bolt 313 to secure the electric wire twisting mechanism 3 to a base 6 so that the electric wire twisting mechanism 3 deviates from the electric wire top clamping mechanism 2 on the base 6 (see FIG. 5); a pair of gear wheels 32 and 33 parallely mounted on the vertical steering board 31 at the back side with a bearing block 34 retained therebetween, which gear wheels 32 and 33 are carried to rotate by the linking rod 133 through a corrugated belt 35 thereon., a pressure device 36 disposed above the gear wheels 32 and 33 and comprising an adjusting block 361 being connected to the adjusting mechanism 4 and having two through-holes 366 bilaterally made thereon, a flexible pressure plate 362 having two bolt holes 363 bilaterally made thereon for insertion therethrough of two adjusting screws 365 which are inserted from the two through-holes 366 of the adjusting block 361 to secure the flexible pressure plate 362 to the adjusting block 361 with two spring elements 364 bilaterally retained therebetween so as to force the pressure plate 362 to flexibly press on the corrugated belt 35.

The position adjusting mechanism 4 includes an adjusting lug 51 being connected to the division plate 5 and having an elongated slot 511 thereon, and a steering block 53 having its one end connected to the elongated slot 511 by a bolt 52 and its other end connected to the adjusting block 361 of the electric wire twisting mechanism 3.

The operation of the present machine is outlined hereinafter (with reference made to the annexed drawings):

As soon as the motor 11 is started, the two upper belt pulleys 21 and 144 are carried to rotate in counter direction against the two lower belt pulleys 24, and the middle contact portions of the two endless belts 23 and 24 are synchronously carried to move in same direction.

Thus, when the wire top 7 of a cable 8 is inserted in the electric wire top clamping mechanism 2 it will be carried to move horizontally without revolution. During operation, the corrugated belt 35 of the electric wire twisting mechanism 3 is carried by the gear wheels 32 and 33 to rotate in same direction as the middle contact portions of the two endless belts 23 and 24, and the flexible pressure plate 362 is retained immovable. When a cable 8 is delivered to the electric wire twisting mechanism 3, it is immediately carried by the corrugated belt 35 to rotate through the flexible pressure plate 362. Therefore, when a cable 8 is placed in the electric wire top clamping mechanism 2 and the electric wire twisting mechanism 3, the wire top 7 of such a cable 8 is carried to move smoothly without revolution, and the root portion of such a cable 8 is carried to rotate while moving. Thus, the threads of the wire top 7 of such a cable can be efficiently twisted into a cord. Because the electric wire twisting mechanism 3 deviates from the electric wire top clamping mechanism 2, the wire top 7 of a cable 8 will be carried by the electric twisting mechanism to gradually separate from the electric wire top clamping mechanism 2 during operation. During twisting operation, the cable 8 which is inserted for twisting will be simultaneously stretched straight by the electric wire top clamping mechanism 2 and the electric wire twisting mechanism 3.

The position of the pressure device 36 of the electric wire twisting mechanism 3 relative to the electric wire top clamping mechanism 2 can be flexibly adjusted through the position adjusting mechanism 4 to increase or reduce its range of deviation from the electric wire top clamping mechanism 2 according to the length of electric wire top to twist. Further, a plurality of fine stripes are transversely made on the bottom surface 3621 of the flexible pressure plate 362 such that slender threads of an electric wire of small caliber can be efficiently twisted into a cord.

I claim:

1. An electric wire twisting machine, including:

a transmission mechanism comprising a motor, a driving rod set and a driving gear set, said driving rod set and driving gear set being carried to rotate by said motor;

an electric wire top clamping mechanism carried to operate by said driving gear set; and electric wire twisting mechanism carried to operate by said driving rod set; and a position adjusting mechanism to adjust the positioning of said electric wire twisting mechanism relative to said electric wire top clamping mechanism;

wherein said electric wire top clamping mechanism clamps and carries in a linear direction the threads of the wire top of an electric wire inserted therein while simultaneously said electric wire twisting mechanism twists and carries in a linear direction the root portion of such an electric wire so as to let the threads of the wire top of such an electric wire be twisted into a cored.

2. An electric wire twisting machine according to claim 1, wherein said driving gear set and driving rod set are carried to rotate by said motor through a corrugated driving belt mounted thereon.

3. An electric wire twisting machine according to claim 2, wherein said driving rod set comprises a driving rod gear wheel driven to rotate by said corrugated driving belt, an extension rod coupled with said driving rod gear wheel through universal coupling, and a linking rod coupled with said extension rod and penetrating through a division plate thereof to drive said electric wire twisting mechanism to operate; and said driving gear set comprises a first gear wheel driven to rotate by said corrugated driving belt, a second gear wheel coaxially connected to said first gear wheel and having its gear shaft penetrating through said division plate to carry an upper belt pulley to rotate, a third gear wheel identical to and engaged with said second gear wheel and having its gear shaft penetrating through said division plate to carry a lower pulley wheel to rotate.

4. An electric wire twisting machine according to claim 3, wherein said driving rod gear wheel of said driving rod set has teeth in number much more than said first gear wheel of said driving rod set.

5. An electric wire twisting machine according to claim 3, wherein said electric wire top clamping mechanism comprises an upper belt pulley and a lower belt pulley respectively mounted on said division plate at the back and disposed opposite to and in parallel with the upper and lower pulleys of said driving gear set, a first endless belt mounted on the upper belt pulley of said electric wire top clamping mechanism and the upper belt pulley of said transmission mechanism, a second endless belt mounted on the lower belt pulley of said electric wire top clamping mechanism and the lower belt pulley of said transmission mechanism, and two holding-down devices mounted on said division plate and respectively positioned in said first and second endless belts.

6. An electric wire twisting machine according to claim 5, wherein said two holding-down devices are oppositely disposed to face each other, each comprising a positioning seat, a pair of slide rods set in said positioning seat, a pair of spring elements mounted on said pair of slide rods, and a pressure plate mounted on said pair of slide rods and constantly forced by said spring elements to press on either one of said first and second endless belts.

7. An electric wire twisting machine according to claim 3, wherein said electric wire twisting mechanism comprises a vertical steering board coupled with said linking rod of said transmission mechanism; a pair of rotary gear wheels parallely mounted on said vertical steering board at the back side with a bearing block retained therebetween, said two rotary gear wheels being carried to rotate by said linking rod through a corrugated belt thereon; a pressure device disposed above said rotary gear wheels and connected to said position adjusting mechanism.

8. An electric wire twisting machine according to claim 7, wherein a transverse lug is mounted on said vertical steering board at its lower front end and comprises thereon a control slot for insertion therethrough of a bolt to secure said electric wire twisting mechanism to a base.

9. An electric wire twisting machine according to claim 7, wherein said pressure device comprises an adjusting block connected to said adjusting mechanism and having through-holes bilaterally made thereon, a flexible pressure plate having bolt holes bilaterally made thereon for insertion therethrough of two adjusting screws which are inserted from said through-holes of said adjusting block to secure said flexible pressure plate to said adjusting block with spring elements bilaterally retained therebetween so as to force said pressure plate to flexibly press on the corrugated belt which is mounted on said rotary gear wheels.

10. An electric wire twisting machine according to claim 9, wherein said position adjusting mechanism comprises an adjusting lug connected to said division plate and having an elongated slot made thereon, and a steering block having its one end connected to said elongated slot by a bolt and its other end connected to said adjusting block of said electric wire twisting mechanism.

11. An electric wire twisting machine according to claim 1, wherein said electric wire twisting mechanism and said electric wire top clamping mechanism are disposed to deviate from each other from respective front ends from which electric wire is inserted for twisting process.

* * * * *